US011345504B2

(12) United States Patent
Pedmo

(10) Patent No.: US 11,345,504 B2
(45) Date of Patent: May 31, 2022

(54) HOT-FILLABLE PLASTIC CONTAINER WITH FLEXIBLE BASE FEATURE

(75) Inventor: Marc A. Pedmo, Litchfield, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 12/648,647

(22) Filed: Dec. 29, 2009

(65) Prior Publication Data

US 2010/0163513 A1 Jul. 1, 2010

Related U.S. Application Data

(60) Provisional application No. 61/141,812, filed on Dec. 31, 2008.

(51) Int. Cl.
*B65D 1/02* (2006.01)
*B65D 79/00* (2006.01)

(52) U.S. Cl.
CPC ..... *B65D 1/0276* (2013.01); *B65D 79/0081* (2020.05)

(58) Field of Classification Search
CPC ..... B65D 1/0276; B65D 79/005
USPC ..... 215/370–375
See application file for complete search history.

(56) References Cited

U.S. PATENT DOCUMENTS 3,409,167 A 11/1968 Blanchard
4,040,233 A 8/1977 Valyi
4,125,632 A 11/1978 Vosti et al.
4,318,882 A 3/1982 Agrawal et al.
4,338,765 A 7/1982 Ohmori et al.
4,356,681 A 11/1982 Barnes
4,642,968 A * 2/1987 McHenry et al. ..... 53/425
4,863,046 A 9/1989 Collette et al.
5,090,180 A 2/1992 Sorensen
5,281,387 A 1/1994 Collette et al.
5,419,866 A 5/1995 Valyi
5,540,879 A 7/1996 Orimoto et al.
5,614,148 A 3/1997 Beck et al.
5,673,808 A 10/1997 Valyi et al.
5,735,420 A 4/1998 Nakamaki et al.
5,884,792 A 3/1999 Krishnakumar et al.
(Continued)

FOREIGN PATENT DOCUMENTS

DE 19520925 A1 12/1996
FR 2772365 A1 6/1999
(Continued)

OTHER PUBLICATIONS

ISA/US; USPTO; International Search Report and Written Opinion issued in counterpart PCT Application No. PCT/US2009/069707; dated Feb. 25, 2010.
(Continued)

*Primary Examiner* — Tri M Mai
(74) *Attorney, Agent, or Firm* — Fishman Stewart PLLC

(57) ABSTRACT

A base for a plastic container including an outer support portion; a structured formation ring including a plurality of sequential formations; an inner inversion portion disposed radially inwardly of the structured formation ring; and a central portion. In an embodiment, the sequential formations are disposed in a substantially ring-like configuration and at least the inner inversion portion is configured to flex in response to internal vacuum forces associated with said container.

21 Claims, 10 Drawing Sheets

(56) References Cited

U.S. PATENT DOCUMENTS

| | | | | |
|---|---|---|---|---|
| 6,062,408 | A | 5/2000 | Beck et al. | |
| 6,502,369 | B1 | 1/2003 | Andison et al. | |
| 6,568,156 | B2 | 5/2003 | Silvers et al. | |
| 6,595,380 | B2 * | 7/2003 | Silvers | 215/373 |
| 6,612,451 | B2 | 9/2003 | Tobias et al. | |
| 6,857,531 | B2 | 2/2005 | Slat et al. | |
| 6,942,116 | B2 | 9/2005 | Lisch et al. | |
| 6,983,858 | B2 | 1/2006 | Slat et al. | |
| 7,150,372 | B2 | 12/2006 | Lisch et al. | |
| 7,416,089 | B2 | 8/2008 | Kraft et al. | |
| 7,451,886 | B2 | 11/2008 | Lisch et al. | |
| 7,543,713 | B2 * | 6/2009 | Trude et al. | 215/373 |
| 7,574,846 | B2 | 8/2009 | Sheets et al. | |
| 8,011,166 | B2 | 9/2011 | Sheets et al. | |
| 8,028,498 | B2 | 10/2011 | Melrose | |
| 8,584,879 | B2 * | 11/2013 | Melrose et al. | 215/373 |
| 8,590,729 | B2 * | 11/2013 | Kamineni | B65D 1/0276 220/608 |
| 2002/0004090 | A1 | 1/2002 | LaFleur | |
| 2002/0020149 | A1 | 2/2002 | Silvers et al. | |
| 2003/0110736 | A1 | 6/2003 | Boyd | |
| 2003/0196926 | A1 | 10/2003 | Tobias et al. | |
| 2004/0131735 | A1 | 7/2004 | Korengel et al. | |
| 2005/0121408 | A1 | 6/2005 | Deemer et al. | |
| 2006/0138074 | A1 * | 6/2006 | Melrose | 215/373 |
| 2007/0051073 | A1 | 3/2007 | Kelley et al. | |
| 2007/0084821 | A1 * | 4/2007 | Bysick et al. | 215/373 |
| 2007/0215571 | A1 * | 9/2007 | Trude | 215/373 |
| 2007/0231530 | A1 | 10/2007 | Pedmo et al. | |
| 2008/0047964 | A1 * | 2/2008 | Denner et al. | 220/624 |
| 2009/0090728 | A1 | 4/2009 | Trude et al. | |
| 2009/0091067 | A1 | 4/2009 | Trude et al. | |
| 2009/0092720 | A1 | 4/2009 | Trude et al. | |
| 2009/0242575 | A1 * | 10/2009 | Kamineni | B65D 1/0276 220/608 |
| 2010/0018166 | A1 | 1/2010 | Outreman | |
| 2010/0163513 | A1 | 7/2010 | Pedmo | |
| 2011/0278308 | A1 | 11/2011 | Iizuka et al. | |

FOREIGN PATENT DOCUMENTS

| | | | | |
|---|---|---|---|---|
| FR | 2896232 | A1 | | 7/2007 |
| JP | S57-17730 | | * | 1/1982 |
| JP | 2004217265 | A | | 8/2004 |
| JP | 2006006133 | A | | 1/2006 |
| JP | 2007-253997 | A | * | 10/2007 |
| JP | 2007269392 | A | | 10/2007 |
| JP | 2007-290772 | A | * | 11/2007 |
| JP | 2007-24314 | A | * | 2/2008 |
| JP | 2008024314 | A | * | 2/2008 |
| JP | 2008044633 | A | * | 2/2008 |
| JP | 2008068898 | A | | 3/2008 |
| JP | 2008-100720 | A | * | 5/2008 |
| JP | 2010535137 | A | | 11/2010 |
| WO | 2007127337 | A2 | | 11/2007 |

OTHER PUBLICATIONS

European Patent Office; Extended European Search Report issued in corresponding European Application No. 09837116.4; dated Dec. 5, 2013.

* cited by examiner

HOT-FILLABLE PLASTIC CONTAINER WITH FLEXIBLE BASE FEATURE

CROSS-REFERENCE TO RELATED APPLICATION

This application claims the benefit of U.S. Provisional Application No. 61/141,812, filed Dec. 31, 2008, which application is fully incorporated herein by reference.

TECHNICAL FIELD

The present invention relates generally to the field of plastic containers, particularly plastic containers having an improved base portion design to accommodate hot-fill conditions.

BACKGROUND

Today, a great number of plastic containers are filled with liquids and other contents at elevated temperatures. However, as the product within the container cools, the volume taken up by the product decreases, inducing a partial vacuum that exerts an inward force on the walls of the container. Containers that are intended to be filled by a "hot-fill" process are commonly referred to as hot-fill containers. The design of hot-fill containers is influenced by, among other things, a desire to account for anticipated content cooling/shrinkage and associated forces.

SUMMARY

A base for a plastic container including an outer support portion; a structured formation ring including a plurality of sequential formations; an inner inversion portion disposed radially inwardly of the structured formation ring; and a central portion. In an embodiment, the sequential formations are disposed in a substantially ring-like configuration and at least the inner inversion portion is configured to flex in response to internal vacuum forces associated with said container.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
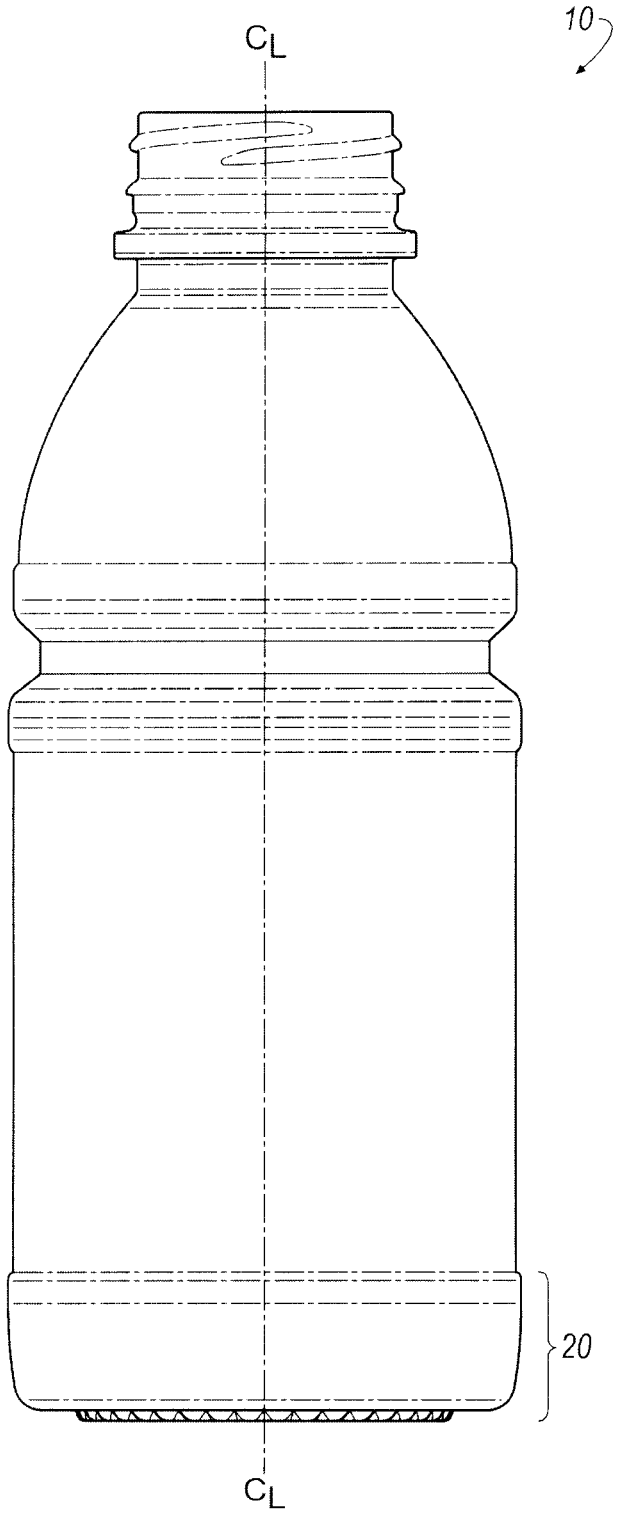
FIG. 1 generally illustrates a plastic container according to an embodiment of the invention.
Figure 2:
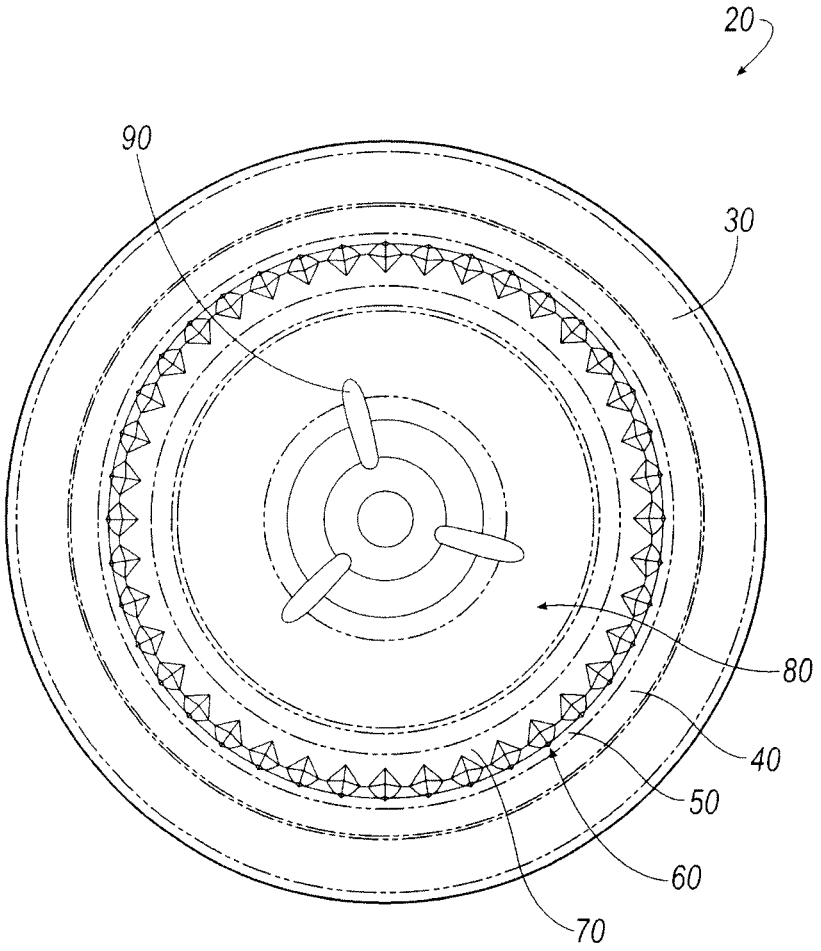
FIG. 2 is a bottom plan view of a container base portion according to an embodiment of the invention.

FIG. 1 generally illustrates a plastic container 10 having a vertical centerline CL and including a base portion 20 according to an embodiment of the present invention. The container 10, and consequently the base 20, may be comprised of a polymer, such as without limitation polyethylene terephthalate (PET), and may be biaxially oriented. A plan view of the base portion 20 is generally shown in FIG. 2. The invention is not, however, limited to the type or style of container shown, and various other sizes and configurations (such as, for example and without limitation, the configuration generally illustrated in FIG. 7) may come within the scope and spirit of the present invention.

The base portion 20 of the illustrated embodiment includes an outer support portion (which may take the form of an annular support ring 30); a first inversion portion (e.g., first inversion ring 40); a flat (or step portion) 50; a structured formation ring 60 (also referred to as a "zipper ring"); a second inversion portion 70; and a central portion 80. As generally illustrated, central portion 80 may include a domed or elevated portion, including those provided in connection with various conventional containers. Further, as generally illustrated, the base portion 20 may also include one or more structural reinforcing formations 90.

In embodiments, the flat (or step portion) 50 may be provided between an outer support ring 30 and a zipper ring, and may further be provided between a first inversion portion 40 (which may be an angled segment/portion) and a zipper ring 60. The flat (or step portion) 50 may be substantially flat, and for some embodiments may be generally perpendicular to the vertical centerline CL. However, some degree of angularity (from perpendicular) with the flat 50 may also be provided with some embodiments.

The outer support portion, which may comprise an annular support ring 30, can be configured to support the container 10 on a surface. As perhaps better illustrated in FIGS. 5 and 6, the first inversion portion may comprise an angled segment, i.e., angled with respect to the vertical centerline CL of the container.

In embodiments of the invention, the structural reinforcing formations may include a plurality of radially extending ribs 90—the size and/or shape of which may be varied. In the illustrated embodiment three radially extending ribs 90 are shown disposed at 120 degree intervals about the vertical centerline CL of the container 10. Additionally, the structural reinforcing formations that may be provided can be configured to extend inwardly (e.g., inward recesses or slits) and/or outwardly with respect to adjacent wall portions of the container base portion 20. However, it is noted that the invention is not limited to the illustrated structural reinforcing formation, and various other formations known to those of skill in the art may be employed in addition to, or in lieu of, the depicted formations.

Figure 3:
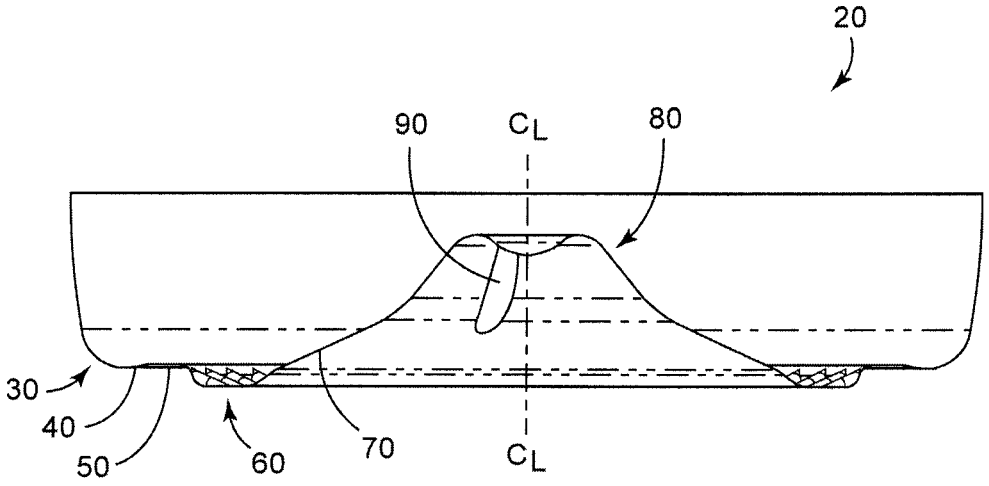
FIG. 3 is front sectional view of a portion of a container base portion according to an embodiment of the invention.
Figure 3A:
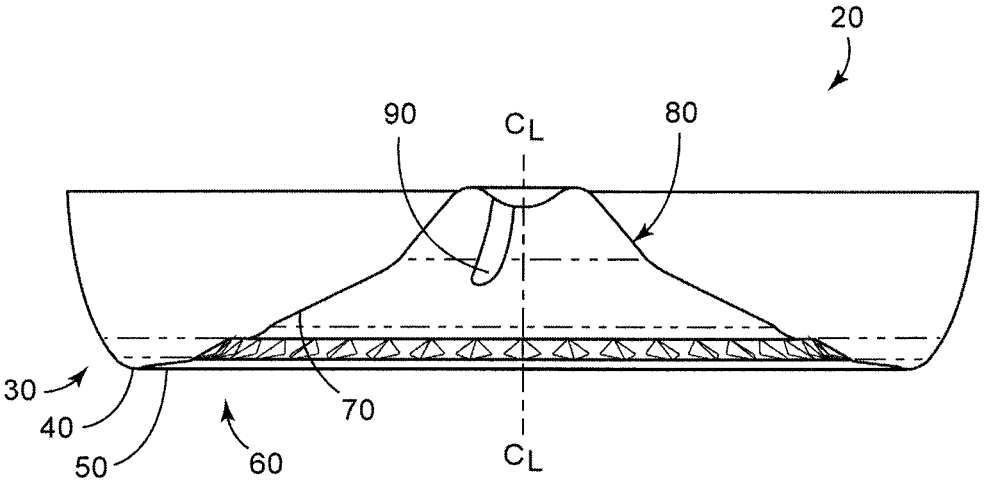
FIG. 3A is a front sectional view of a portion of a base of container of the type shown in FIG. 3 illustrated in a second/elevated position.
Figure 4:
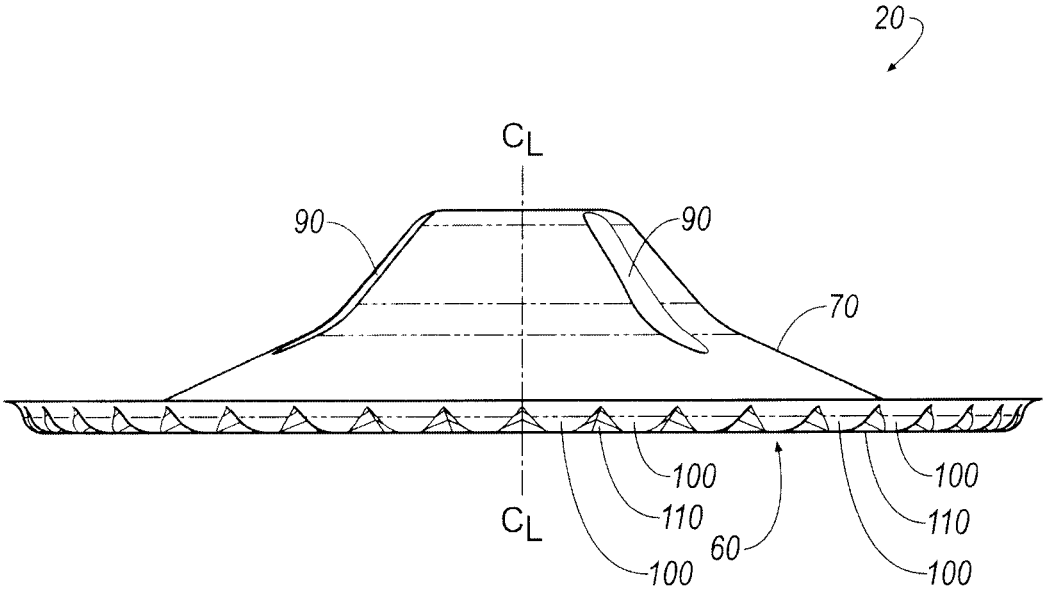
FIG. 4 is a front partial perspective view of a container base portion according to an embodiment of the invention.

FIG. 3 generally depicts a front sectional view of a portion of a container base portion 20 according to an embodiment of the invention. The container illustrated in FIG. 3 being shown in an unfilled condition. A front partial perspective view of a container base portion of the type shown in FIG. 3 is illustrated in FIG. 4. As generally illustrated in FIG. 4, structural formation ring (or zipper ring) 60 may comprise a plurality of sequential formations 110 (also referred to as "teeth"). In an embodiment, sequential formations 110 may extend inwardly relative to immediately adjacent portions of the base. For other embodiments, sequential formations 110 may extend outwardly with respect to immediately adjacent portions of the base. As illustrated, adjacent teeth 110 (which are shown in FIG. 2 as somewhat "diamond"-shaped formations) may be separated, in whole or in substantial part, by intermediate surface portions 100 provided therebetween. While "diamond"-shaped teeth 110 are illustrated in connection with certain embodiments, other constructions that may provide the intended functionality (such as, without limitation, constructions involving a plurality of teeth "triangular"-shaped teeth) may instead be provided or, for some embodiments, differing configurations of teeth may be interspersed in patterns (e.g., alternating). In an embodiment intermediate surface portions 100 may comprise generally planar portions or segments. Additionally, for some embodiments, the sequential formations 110 of the zipper ring 60 may be interrupted by one or more interruption formations, e.g., lugs or orientation formations. The zipper ring 60—which can comprise an annular segment including a plurality of alternating teeth 110 and intermediate surface portions 100—can be configured to serve as a hinge point, and can distribute stress concentration forces (created from a cooling vacuum) substantially evenly around the perimeter of the support ring 30. For embodiments such a configuration can alleviate potential for creasing and permit more uniform displacement of the support ring 30 under a vacuum. Moreover, with reference to the illustrated embodiment, a flat 50 may surround the zipper ring 60 and may additionally serve as an outer inversion ring—which can work in conjunction with the zipper ring 60 to permit a greater displacement of the base portion 20 when under vacuum pressure.

Figure 5:
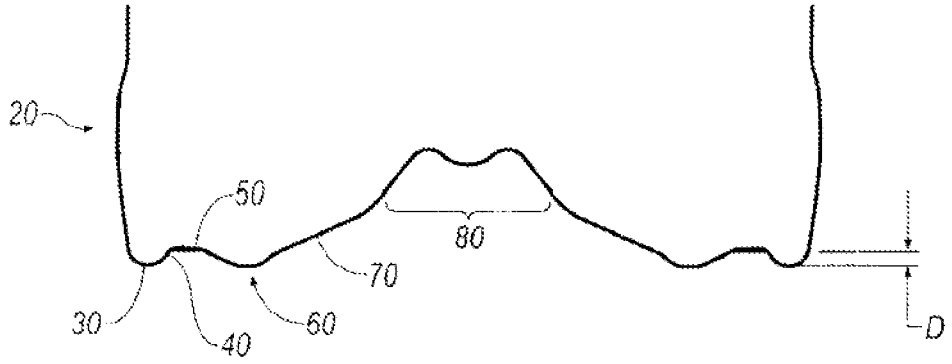
FIG. 5 is a side view outline of a container base portion according to an embodiment of the invention, shown prior to hot-filling.
Figure 6:
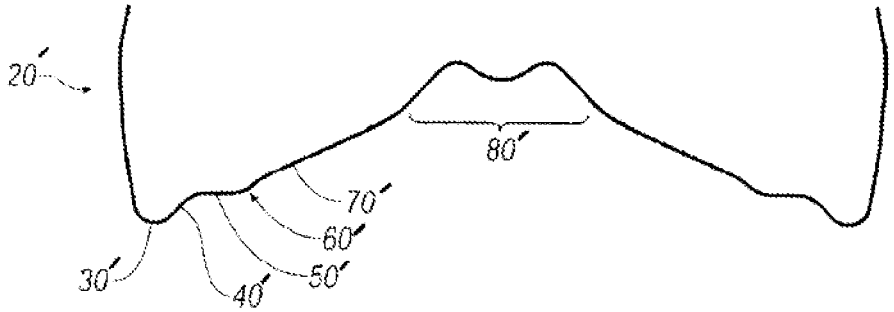
FIG. 6 is a side view outline of a container base portion of the type illustrated in FIG. 5, shown after hot-filling (i.e., after cooling)

FIG. 5 generally illustrates a side view outline of a container base portion 20 according to an embodiment of the invention, shown prior to hot-filling. FIG. 6 generally illustrates the base portion 20 shown in FIG. 5, after hot-filling i.e., after the contents of the container 10 have cooled and the container has experienced associated vacuum forces; however, the various dimensions are merely exaggerations of the same bottle (as between FIGS. 5 and 6) to illustrate movement of elements and should not be scaled. For convenient reference, elements designated in FIG. 6 with a prime sign generally correspond to similarly designated elements illustrated in FIG. 5 without a prime sign. As generally illustrated in FIG. 5, in the pre-hot-fill condition, the zipper ring 60 may extend downwardly to a level that is at or about the level of the support ring 30. Moreover, for some embodiments, the zipper ring 60 associated with an unfilled container 10 may extend below the level of the support ring 30.

Various transportation techniques may be used to convey containers that are provided in accordance with the teachings of the invention. For example, without limitation, various table conveyance and/or neck-directed carrying options (including those that utilize air conveyance) may be employed for embodiments of the invention, including those in which the zipper ring **60*a* of an unfilled container extends below the level of the support ring 30**.

With continuing reference to FIG. 5, a distance D is generally illustrated. Distance D represents a difference in height between the flat 50 and the lowermost portion of support ring 30. For some embodiments, without limitation, distance D may be in the order of 0.065 to 0.010 inches. Further, for some other embodiments where container base portion 20 does not include an outer inversion portion, without limitation, distance D may be in the order of 0.065 to 0.000 inches.

By way of example, without limitation and depending, in part on the overall total package weight, for embodiments of the invention—(a) the wall thickness of the zipper ring **60*a* may range from 0.008 to 0.030 inches; and (b) the wall thickness of the first (outer) inversion ring 40** may range from 0.006 to 0.035 inches.

Container 10 is generally adapted to be hot-filled with liquid having a temperature of between 140° and 210° Fahrenheit. By way of example, without limitation, for embodiments of the invention, container 10 may be filled at between 160° and 190° Fahrenheit.

Figure 7:
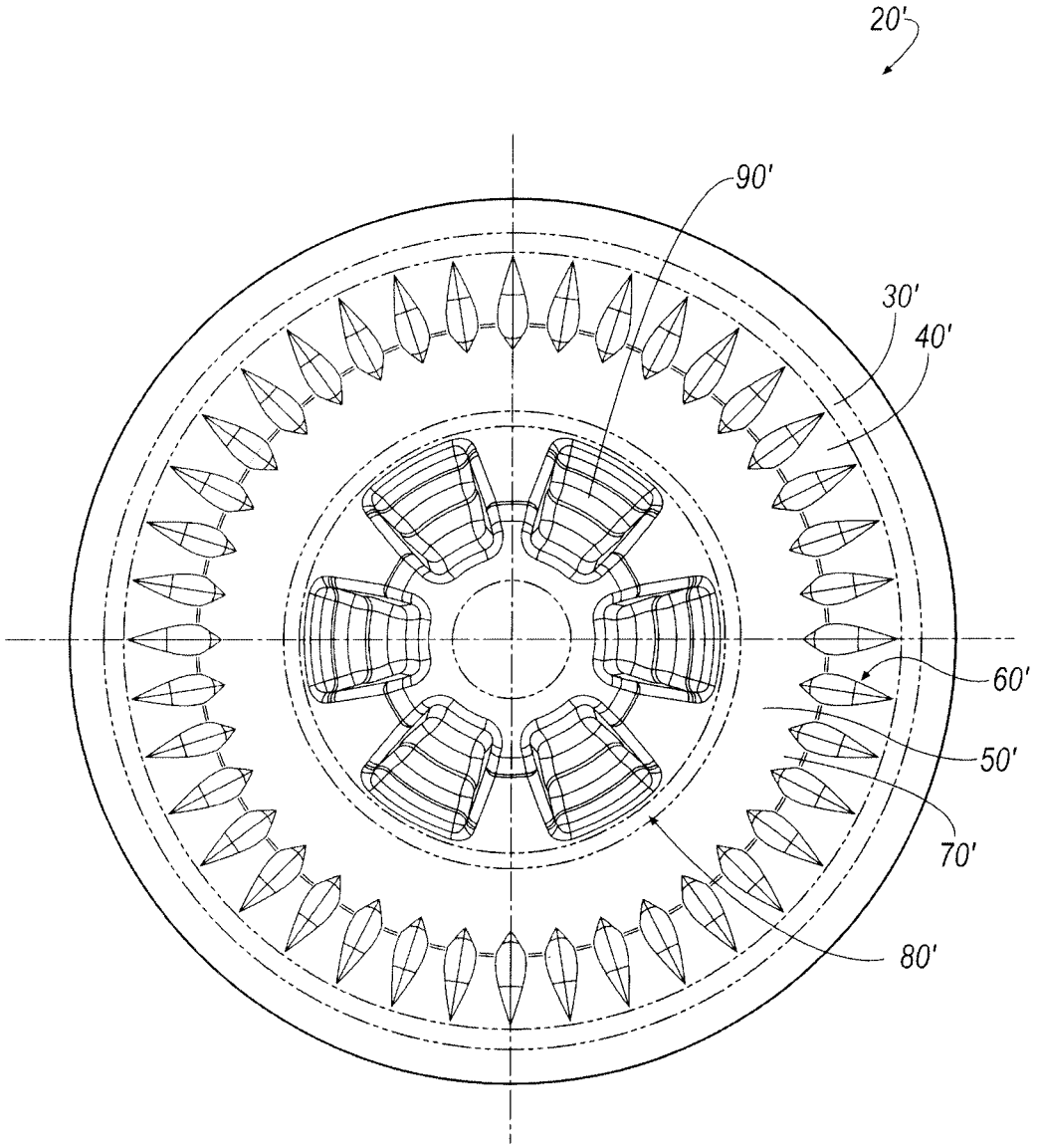
FIG. 7 is a bottom plan view of a container base portion according to another embodiment of the invention.

A plan view of another embodiment of a base portion 20' according to teachings of this disclosure is generally shown in FIG. 7. The base portion 20' of the illustrated embodiment includes an outer support portion (which may take the form of an annular support ring 30'); a first inversion portion (e.g., first inversion ring 40'); a flat (or step portion) 50'; a structured formation ring 60' (also referred to as a "zipper ring"); a second inversion portion 70'; and a central portion 80'. As generally illustrated, central portion 80' may include a domed or elevated portion, including those provided in connection with various conventional containers. Further, as generally illustrated, the base portion 20' may also include one or more structural reinforcing formations 90'. It is additionally noted that the central portion 80' may be configured in various other forms. For instance, and without limitation, central portion 80' may instead be configured as generally illustrated in connection with the embodiment of central portion 80 shown in FIG. 2.

Figure 8:
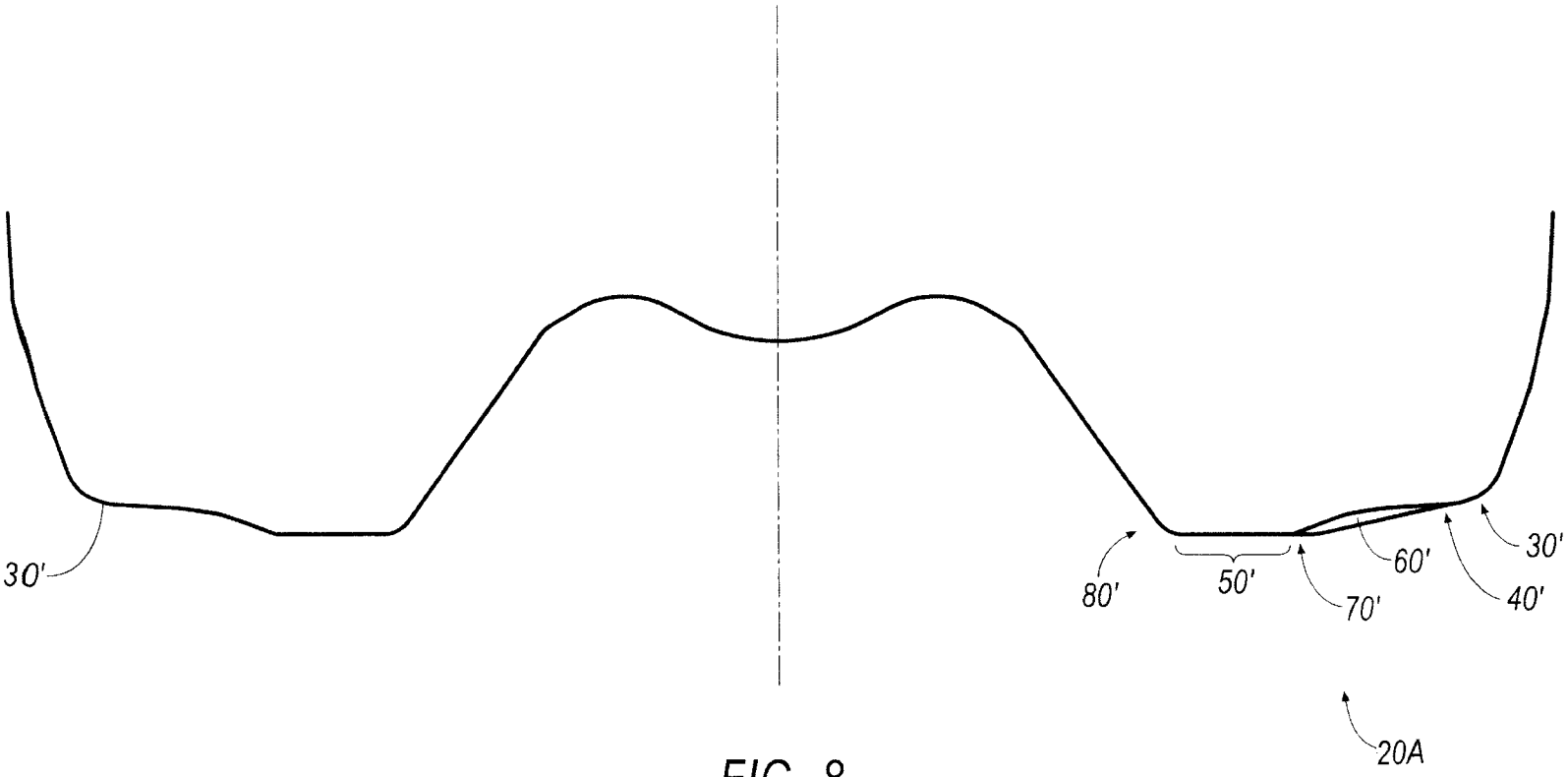
FIG. 8 is a side view outline of a container base portion according to another embodiment of the invention, shown prior to hot-filling.
Figure 9:
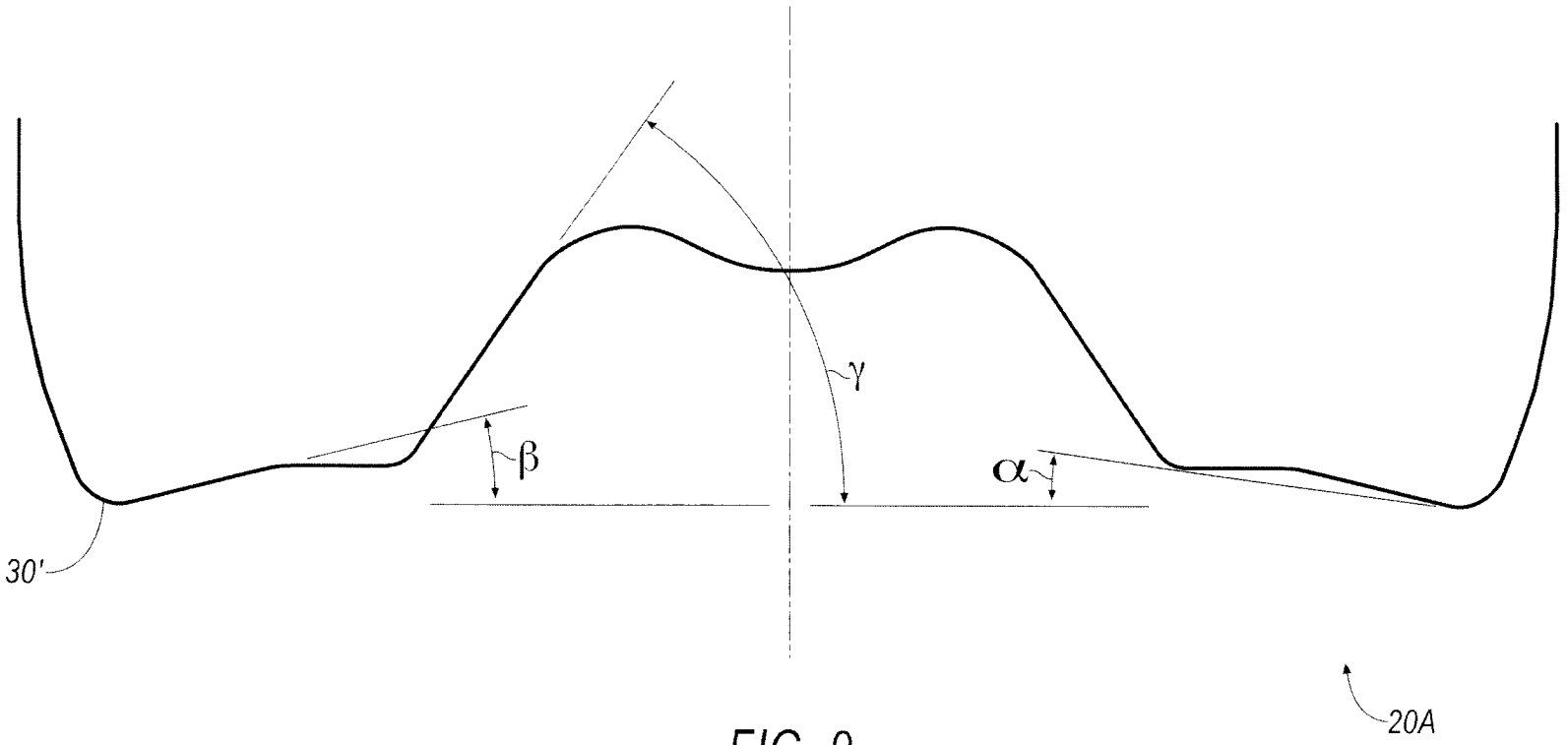
FIG. 9 is a side view outline of a container base portion of the type illustrated in FIG. 8, shown after hot-filling (i.e., after cooling)

FIG. 8 generally illustrates a side view outline of a container base portion 20A according to an embodiment of the invention, shown prior to hot-filling. FIG. 9 generally illustrates the base portion 20A shown in FIG. 8, after hot-filling—i.e., after the contents of the container have cooled and the container has experienced associated vacuum forces. As generally illustrated in FIG. 8, in the pre-hot-fill condition, the zipper ring 60' may extend downwardly to a level that is perceptively lower than, or beneath, the level of the support ring 30'. FIG. 9 illustrates a configuration in which, after the effect of vacuum forces, the support ring 30' then transitions to a level that is below or beneath the associated zipper ring. FIG. 9 also depicts some angular dimensions that may be associated with embodiments of the disclosure. For example, illustrated angle $\alpha$ may be 8.0°±5.0°; illustrated angle $\beta$ may be 14.0°±5.0°; and illustrated angle $\gamma$ may be 55°±25°.

Figure 10:
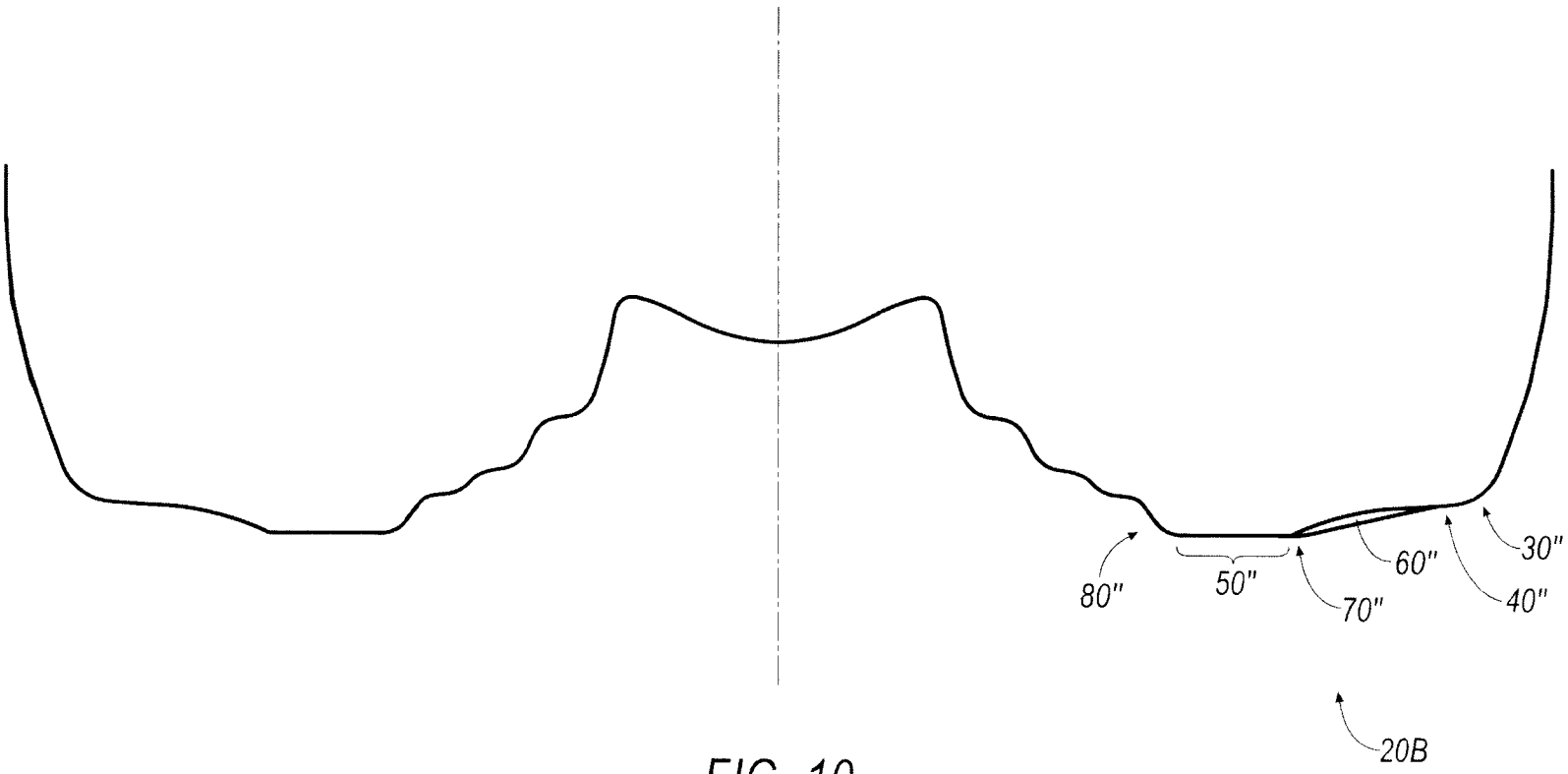
FIG. 10 is a side view outline of a container base portion according to yet another embodiment of the invention, shown prior to hot-filling.
Figure 11:
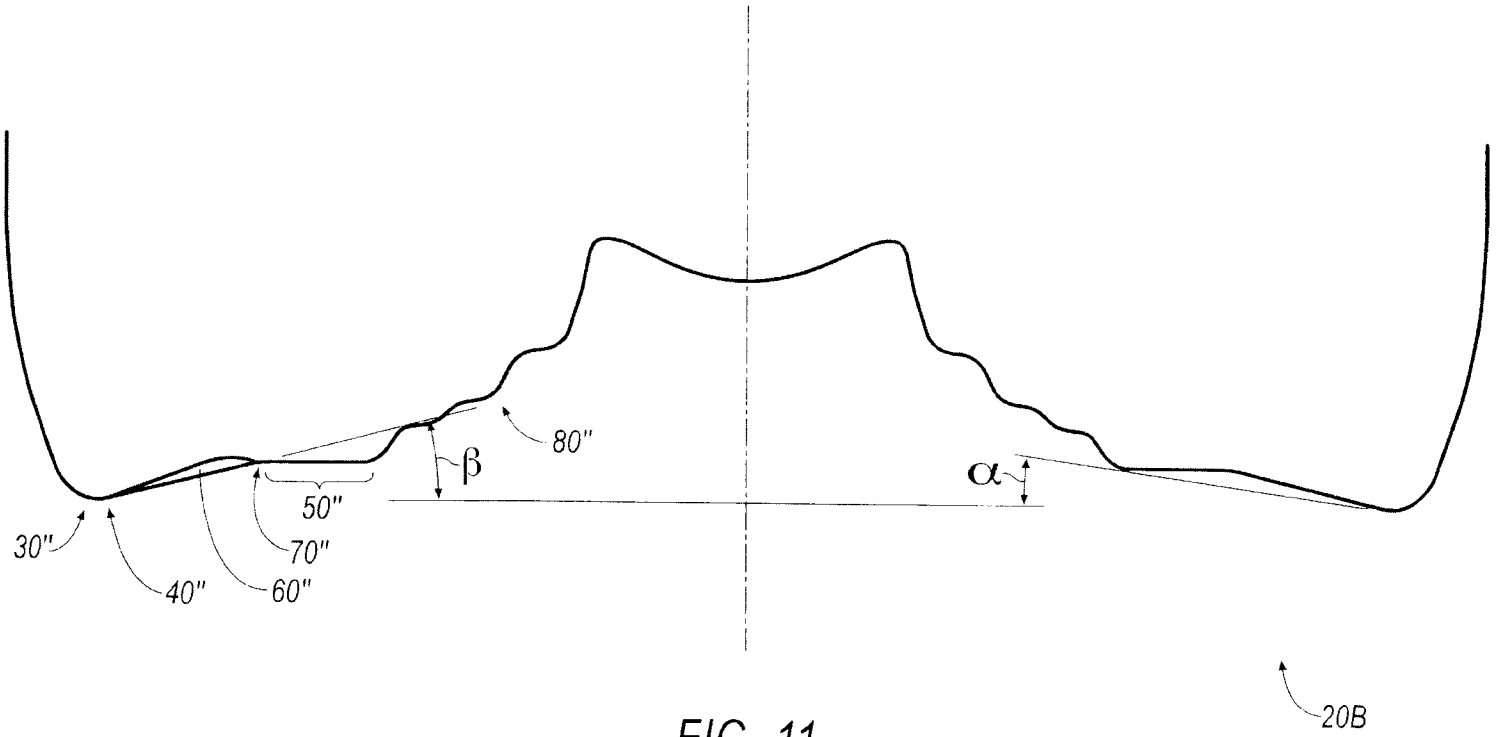
FIG. 11 is a side view outline of a container base portion of the type illustrated in FIG. 10, shown after hot-filling (i.e., after cooling).

FIG. 10 generally illustrates a side view outline of a container base portion 20B according to another embodiment of the invention, shown prior to hot-filling. FIG. 11 generally illustrates the base portion 20B shown in FIG. 10, after hot-filling—i.e., after the contents of the container have cooled and the container has experienced associated vacuum forces. As also generally illustrated in FIG. 10, in the pre-hot-fill condition, the zipper ring 60" may extend downwardly to a level that is lower than, or beneath, the level of the support ring 30". FIG. 11 illustrates a configuration in which the zipper ring 60", after the effect of vacuum forces, then extends above the level of support ring 30". FIG. 11 also expressly depicts several angular dimensions, angles $\alpha$ and $\beta$, that may be associated with embodiments of the disclosure. In embodiments, the illustrated angles associated with FIG. 11 may be the same or substantially equivalent to the angular ranges disclosed in connection with FIG. 9, that is, angle $\alpha$ shown in FIG. 11 may also be 8.0°±5.0°, and angle $\beta$ may also be 14.0°±5.0°.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims appended hereto and their equivalents.

What is claimed is:

1. A base for a plastic container comprising:

an outer support portion;

a structured formation ring including a plurality of sequential formations, the sequential formations disposed in a substantially ring-like configuration;

an inner inversion portion disposed radially inwardly of the structured formation ring;

a substantially horizontal flat portion provided between the outer support portion and the structured formation ring; and a central portion that includes a domed or elevated portion with a segment extending upwardly from, and at a steeper angle than, the inner inversion portion;

wherein the structured formation ring, the inner inversion portion, and the central portion are configured to move, together in combination, upwardly relative to a support surface, to directly accommodate internal vacuum forces associated with the cooling of the contents of said container without requiring the application of external forces;

wherein the structured formation ring is configured to move from a first vertical level that is below the outer support portion in an unfilled condition to a second vertical level that is above the outer support portion in response to internal vacuum forces associated with the cooling of the contents; and wherein the inner inversion portion is disposed above a vertical level of the structured formation ring when the structured formation ring is at the first vertical level and when the structured formation ring is at the second vertical level.

2. The base of claim 1, wherein the outer support portion comprises an annular support ring; and the inner inversion portion is disposed above a vertical level of the annular support ring when the structured formation ring is at the first vertical level and when the structured formation ring is at the second vertical level.

3. A base for a plastic container comprising:

an outer support portion;

a structured formation ring including a plurality of sequential formations, the sequential formations disposed in a substantially ring-like configuration;

an inner inversion portion disposed radially inwardly of the structured formation ring;

a substantially horizontal flat portion provided between the outer support portion and the structured formation ring; and a central portion that includes a domed or elevated portion with a segment extending upwardly from, and at a steeper angle than, the inner inversion portion;

wherein the structured formation ring, the inner inversion portion, and the central portion are configured to move, together in combination, upwardly relative to a support surface, to directly accommodate internal vacuum forces associated with the cooling of the contents of said container without requiring the application of external forces;

wherein the structured formation ring is disposed at a first vertical level that is below the outer support portion in an unfilled condition and is disposed at a second vertical level that is above the outer support portion and corresponds to a response to internal vacuum forces associated with the cooling of the contents; and the inner inversion portion is disposed above a vertical level of the outer support portion when the structured formation ring is at the first vertical level and when the structured formation ring is at the second vertical level; and the flat portion is substantially parallel with the structured formation ring when the structured formation ring is at the second vertical level.

4. The base of claim 1, wherein the central portion includes one or more structural reinforcing formations.

5. The base of claim 1, wherein the central portion includes a plurality of radially extending ribs.

6. The base of claim 5, wherein the ribs are configured to extend inwardly.

7. A plastic container comprising a base according to claim 1.

8. The base of claim 1, comprising an outer inversion portion provided between the outer support portion and the structured formation ring; wherein, the flat portion is substantially flat and is generally perpendicular to a vertical centerline of said container.

9. The base of claim 1, wherein the substantially horizontal flat portion provided between the outer support portion and the structured formation ring is substantially horizontal and flat around the entire circumference of the base; and the substantially horizontal flat portion is disposed at a higher vertical level than the outer support portion when the structured formation ring is at the first vertical level and when the structured formation ring is at the second vertical level.

10. The base of claim 1, wherein the plurality of sequential formations comprise a plurality of teeth and, in a bottom plan view, each of the plurality of teeth is substantially diamond-shaped.

11. A flexible vacuum-responsive base for a plastic container comprising:

an outer support portion;

a structured formation ring including a plurality of sequential formations, the sequential formations disposed in a substantially ring-like configuration;

an outer inversion portion provided between the outer support portion and the structured formation ring;

a flat portion provided between the outer inversion portion and the structured formation ring;

an inner inversion portion; and a central portion that includes a domed or elevated portion with a segment extending upwardly from, and at a steeper angle than, the inner inversion portion;

wherein the structured formation ring, the inner inversion portion, and the central portion are configured to move, together in combination, upwardly relative to a support surface, to directly accommodate internal vacuum forces associated with said container without requiring the application of external forces; the flat portion is substantially flat and is generally perpendicular to a vertical centerline of said container; the plurality of sequential formations comprise a plurality of teeth; and, in a bottom plan view, each of the plurality of teeth has a diamond-shaped configuration;

wherein the structured formation ring is configured to move from a first vertical level that is below the outer support portion in an unfilled condition to a second vertical level that is above the outer support portion in response to internal vacuum forces associated with the cooling of the contents; and wherein an angle between the inner inversion portion and the structured formation ring is substantially the same when the structured formation ring is at the first vertical level and when the structured formation ring is at the second vertical level.

12. A plastic container comprising a base according to claim 11.

13. The base of claim 11, wherein the first vertical level and the second vertical level of the structured formation ring are lower than corresponding vertical levels of the inner inversion portion.

14. The base of claim 3, wherein, the flat portion surrounds the structured formation ring and serves as an outer inversion portion; and the flat portion is substantially parallel with the structured formation ring when the structured formation ring at the second vertical level.

15. The base of claim 3, wherein the plurality of sequential formations comprise a plurality of teeth.

16. The base of claim 15, wherein, in a bottom plan view, each of the plurality of teeth has a diamond-shaped configuration.

17. The base of claim 3, wherein an intermediate surface portion is provided at least in part between adjacent sequential formations.

18. The base of claim 3, wherein the plurality of sequential formations comprises an annular segment including a plurality of alternating teeth and intermediate surface portions.

19. The base of claim 3, wherein the structured formation ring is configured to serve as a hinge point.

20. The base of claim 19, wherein the structured formation ring is configured to distribute stress concentration forces substantially evenly around a perimeter of the base.

21. A plastic container comprising a base according to claim 3.

* * * * *